United States Patent [19]

Maeland

[11] 4,406,700

[45] * Sep. 27, 1983

[54] POWDER PRODUCED BY EMBRITTLING OF METALLIC GLASSY ALLOY BY HYDROGEN CHARGING

[75] Inventor: Arnulf J. Maeland, Succasunna, N.J.

[73] Assignee: Allied Corporation, Morris Township, Morris County, N.J.

[ * ] Notice: The portion of the term of this patent subsequent to Dec. 8, 1998 has been disclaimed.

[21] Appl. No.: 282,898

[22] Filed: Jul. 13, 1981

Related U.S. Application Data

[62] Division of Ser. No. 94,128, Nov. 14, 1979, Pat. No. 4,304,593.

[51] Int. Cl.[3] ..... B22F 9/04

[52] U.S. Cl. ..... 75/251; 75/0.5 BA; 241/23; 423/648 R

[58] Field of Search ..... 75/251, 252, 170, 171, 75/0.5 R, 0.5 B, 0.5 BA, 122, 123 B, 123 D; 148/120, 121, 122, 31.55

[56] References Cited

U.S. PATENT DOCUMENTS

| | | | |
|---|---|---|---|
| 3,856,513 | 12/1974 | Chen et al. | 75/122 |
| 4,063,992 | 12/1977 | Lundgren | 75/251 |
| 4,069,045 | 1/1978 | Lundgren | 75/251 |
| 4,197,146 | 4/1980 | Frischman | 148/31.55 |
| 4,221,587 | 9/1980 | Ray | 75/0.5 C |
| 4,290,808 | 9/1981 | Ray | 75/251 |

*Primary Examiner*—L. Dewayne Rutledge
*Assistant Examiner*—Christopher W. Brody
*Attorney, Agent, or Firm*—Paul Yee; Ernest D. Buff; Gerhard H. Fuchs

[57] ABSTRACT

Metallic glass powder is prepared by charging a solid metallic glass body with hydrogen to effect embrittlement, followed by comminution of the embrittled metallic glass body.

7 Claims, No Drawings

POWDER PRODUCED BY EMBRITTLING OF METALLIC GLASSY ALLOY BY HYDROGEN CHARGING

This is a division, of application Ser. No. 94,128 filed Nov. 14, 1979 now U.S. Pat. No. 4,304,593, issued Dec. 8, 1981.

DESCRIPTION

1. Field of the Invention

The invention relates to amorphous metal powders and in particular to amorphous metal powders having the composition of known glass forming alloys.

2. Description of the Prior Art

Metallic glasses (amorphous metals), including metallic glasses in powder form have been disclosed by Chen et al. in U.S. Pat. No. 3,856,513. They prepared amorphous alloy powders by flash evaporation. They further disclose that powders of amorphous metal having the particle size ranging from about 0.0004 to 0.01 inch can be made by atomizing the molten alloy to droplets of this size and then quenching the droplets in a liquid such as water, refrigerated brine or liquid nitrogen.

A method for making metal flakes suitable for making metal powder for powder metallurgical purposes is disclosed by Lundgren in *German Offenlegungsschrift* No. 2,555,131 published August 12, 1976. The process involves impinging a jet of molten metal against a rotating flat disc. Relatively thin, brittle and easily shattered, essentially dendrite free metal flakes are obtained with between amorphous and microcrystalline structure, from which a metal powder can be obtained by shattering and grinding, for instance in a ball mill. In U.S. Pat. No. 4,063,942 and U.S. Pat. No. 4,069,045 Lundgren discloses a product with amorphous to compact-grained structure.

There remains a need for methods for making amorphous (glassy) metal powder having good properties for use in metallurgical processes.

SUMMARY OF THE INVENTION

In accordance with the invention a method of producing metallic glass powder is provided wherein a solid metallic glass body, usually in filamentary form, is charged with hydrogen to effect embrittlement without causing formation of a crystalline phase. The embrittled metallic glass body is comminuted to powder. In general, removal of hydrogen from the comminuted product, as by exposing it to a substantially hydrogen-free atmosphere e.g., air, results in reversion to a ductile material. Each particle of the ductile glassy metal powder is defined by an irregularly shaped outline resulting from fracture.

DETAILED DESCRIPTION OF THE INVENTION

Metallic glass alloy powders are prepared according to a process involving first exposing a glassy alloy to hydrogen to produce an embrittled state and then comminuting the embrittled alloy to a powder.

A metallic glass is an alloy product of fusion which has been cooled to a rigid condition without crystallization. Such metallic glasses in general have at least some of the following properties: high hardenss and resistance to scratching, great smoothness of a glassy surface, dimensional and shape stability, mechanical stiffness, strength and ductility and a relatively high electrical resistance compared with related metals and alloys and a diffuse X-ray diffraction pattern.

Alloys suitable for use in my process include those known in the art for the preparation for metallic glasses, such as those disclosed in U.S. Pat. Nos. 3,856,513; 3,981,722; 3,986,867; 3,989,517 as well as many others. For example, Chen and Polk in U.S. Pat. No. 3,856,513 issued Dec. 24, 1974 disclose alloys of the composition $M_aY_bZ_c$, where M is at least one of the metals: iron, nickel, cobalt, chromium and vanadium; Y is at least one of the metalloids, phosphorus, boron and carbon; and Z is at least one of aluminum, silicon, tin, germanium, indium, antimony and beryllium with "a" equaling 60 to 90 atom percent, "b" equaling 10 to 30 atom percent and "c" equaling 0.1 to 15 atom percent with the proviso that the sum of a, b and c equals 100 atom percent. Preferred alloys in this range comprise those where "a" lies in the range of 75 to 80 atom percent, "b" in the range of 9 to 22 atom percent, "c" in the range of 1 to 3 atom percent. Furthermore, they disclose alloys with the formula $T_iX_j$ wherein T is at least one transition metal and X is at least one of the elements of the groups consisting of phosphorus, boron, carbon, aluminum silicon, tin, germanium, indium, beryllium and antimony and wherein "i" ranges between 70 and 87 atom percent and "j" ranges between 13 and 30 atom percent, with the proviso that $i+j=100$. However, it is pointed out that not every alloy in this range would form a glassy metal alloy. These alloys are rapidly quenched from the melt by known procedures to obtain splats or filament (e.g. sheets, ribbons, tapes, wires, etc.) of amorphous metal.

Charging the metallic glass body with hydrogen to effect embrittlement can be carried out in any desirable manner, for example by subjecting it to a hydrogen atmosphere under pressure in a closed container or, in another aspect of the present invention, by electrolytic charging by employing the material to be embrittled as a cathode in a hydrogen producing electrolytic bath.

The hydrogen pressure (or hydrogen partial pressure, if other gases are present) necessary to effect embrittlement depends on the alloy. Generally required the hydrogen pressure is at least about 0.1 kg/cm$^2$, preferably to at least about 1 kg/cm$^2$. Pressures of between about 1 kg/cm$^2$ and 200 kg/cm$^2$ are preferred for reasons of convenience (tank pressure). There is no upper limit to the pressure, other than imposed by limits of apparatus design.

Electrolytic charging is obtained by forming a cathode of glassy metal alloy and placing the cathode in an electrolyte solution capable of forming hydrogen at the cathode under electrolysis conditions. Suitable solutions have an electrolyte concentration of from about 0.01 to 10 moles/liter and a pH of from about 1 to 12. Such solutions include e.g. aqueous sulfuric acid, aqueous hydrochloric acid and aqueous ammonia solutions. Anodes useful include inert metals such as platinum, stainless steel, etc. Preferably a diaphragm is employed for separating cathode and anode space. The gas pressure in the cathode is at leas 0.1 kg/cm$^2$ and preferably from about 1 kg/cm$^2$ to 1000 kg/cm$^2$. The current density at the cathode surface is at least about 0.001 amp/cm$^2$ and preferably from about 0.005 amp/cm$^2$ to 0.05 amp/cm$^2$. The electrolytic charging time can be from about ¼ hour to 100 hours. Alloys suitable for electrolytic hydrogen charging include for example TiCu, $Be_{40}Ti_{50}Zr_{10}$, $Be_{35}Zr_{65}$, $Ni_{40}Fe_{40}P_{14}B_6$.

The hydrogen charging temperature may be within the range of from room temperature or lower to just below the glass transition temperature and up to the glass transition temperature, and preferably is within the range of from 350° C. below the glass transition temperature to 50° C. below the glass transition temperature. While processes such as annealing may embrittle glassy metal alloys, such processes are substantially irreversible regarding the loss of ductility of the glassy alloy. Hydrogen charging temperatures well below the glass transition temperature are preferred to avoid structural relaxation resulting in property changes of the glass and to provide for a reversible embrittlement process. For the sake of convenience, charging at room temperature is preferred. The charging time to achieve the desired embrittlement varies depending on temperature, composition of the glass and hydrogen pressure and may range from about 1 minute to 100 hours, and is preferably from about 10 minutes to 10 hours.

Whether the metallic glass body has acquired a sufficient degree of brittleness can be tested by bending procedures. Depending upon the thickness of the ribbon employed initially a suitable radius can be selected for bending the embrittled ribbon. If the ribbon fails when bent around an adequately sized radius, the embrittlement process has been carried far enough. The larger the radius of breaking, the better embrittled the material. For ease of subsequent comminution, materials embrittled according to the present invention should fail when bent around a radius of about 0.1 cm and preferably of about 0.5 cm.

In addition, it is possible to integrate the process of charging of a glassy alloy to produce embrittlement and of comminuting the embrittled glassy alloy. This can be done by comminuting of ribbons under hydrogen pressure. After the glassy material is embrittled by charging with hydrogen, it is relatively easy to comminute same to flake or fine powder, as desired.

Milling equipment suitable for comminution of the embrittled metallic glass includes rod mills, ball mills, impact mills, disc mills, stamps, crushers, rolls and the like. To minimize contamination of the powder, the wearing parts of such equipment are desirably provided with hard and durable facings. Undue heating and ductilization of the powder may be prevented by water cooling of the grinding surfaces. Suitably, but not necessarily, the comminution process is performed in a hydrogen atmosphere to maintain the metallic glass in the hydrogen charged embrittled state as it is being comminuted.

One type of mill suitable for the comminution of embrittled metallic glass is the conventional hammer mill, having impact hammers pivotably mounted on a rotating disc. Disintegration of the metallic glass is effected by the large impact forces created by the very high velocity of the rotating hammers. Another example of a suitable type of mill is the fluid energy mill.

Ball mills are preferred for use in the comminuting step, inter alia because the resultant product has relatively close particle size distribution.

Following comminution, the powder may be screened, for instance, through a 100 mesh screen, if desired, to remove oversize particles. The powder can be further separated into desired particle size fractions; for example, into 325 mesh powder and powder of particle size between 100 mesh and 325 mesh.

Powder of metallic glass made according to the invention process may comprise fine powder with particle size under 100 micron, coarse powder with particle size between 100 micron and 1000 micron and flake with particle size between 1000 and 5000 micron, as well as particles of any other desirable particle size, and of any particle size distribution, without limitation.

After milling the hydrogen can be removed from the glassy metal alloy. Hydrogen removal is associated with subsequent return of ductility to the glassy metal alloy (reversible embrittlement). Methods for removing the hydrogen include releasing the hydrogen pressure, removal of hydrogen by evacuation at room temperature and, in some cases, evacuation while heating to a temperature below the glass transition temperature to facilitate the removal.

A material is called ductile when considerable deformation occurs before fracture. Such deformation can be for example an elongation of a specimen or a bending deformation of a specimen.

While glassy metal alloys upon tempering turn irreversibly brittle and loose their ductility permanently, hydrogen charging of glassy metal alloys reversibly embrittles the glassy metal alloy and upon release of the hydrogen the original ductility substantially returns.

The dissolved hydrogen in the glassy metal alloys reduces temporarily the ductility of the glassy metal alloy over a certain temperature range and at certain deformation rates.

While I do not wish to be bound by any theory, it is believed that a suitable choice of temperature provides a mobility rate of the hydrogen in the glassy metal alloy compatible with the deformation rate whereby the movement of the glassy metal alloy atoms is hampered and brittleness results.

This process produces a new glassy metal alloy powder which exhibits an irregularly shaped outline resulting from fracture but which is nevertheless ductible based on the reversibility of the hydrogen charging process on the ductile properties.

The powder prepared according to the present invention in general does not exhibit sharp edges with notches as typically found in glassy metallic powders prepared according to the process involving chill casting of an atomized liquid as disclosed in commonly assigned copending applications Ser. No. 23,413 and Ser. No. 23,412 filed Mar. 23, 1979. A particular advantage of a powder with less rough edges and good ductility is that the particles can slide against each other and as a result can be compacted to higher density at equivalent pressure compared with an analogous chill cast atomized alloy. A compact of higher density is often a more desirable starting material for powder metallurgical applications. The metallic glass powder of the present invention is useful for powder metallurgical applications.

The examples set forth below further illustrate the present invention and set forth the best mode presently contemplated for its practice.

EXAMPLE 1

A metallic glass in the form of short pieces of ribbon, 2–5 mm long and 2 mm wide, of composition $Fe_{84}B_{16}$ was exposed at room temperature to hydrogen at 135 kg/cm$^2$ pressure in a modified 300 ml stainless steel, commercial hydrogenation apparatus. (Magna Dash unit, made by Autoclave Engineers, Erie, Pa.). The modification consisted of replacing the actuated dasher with a tungsten carbide ball which was brazed to the actuating rod. The impact of the carbide ball, falling under gravitational forces, provided the grinding action. After grinding for 1¾ hours the resulting powdered sample was removed for analysis. The following particle size distribution was determined: −100 to +200 mesh 44.7%; −200 to +325 mesh 39.2%; −325 mesh 16.1%. From X-ray diffraction analysis it was concluded that no crystallization had taken place and that the glassy state was preserved. Thermogravimetric analysis to 900° C. showed no weight loss indicating that any hydrogen absorbed under high pressure was released when the hydrogen pressure was removed. Differential thermal analysis of the powder showed no change in $T_g$ or crystallization behavior from the original sample.

EXAMPLE 2

Glassy metal alloy of the composition $Fe_5Ni_{45}B_{16}Mo_4Cr_{10}Co_{20}$ (atom percent) was ground at room temperature for 1 hour in the Magna Dash Unit under 125 kg/cm$^2$ hydrogen pressure. The particle size distribution was: −20 to +100 mesh 53.8%; −100 to +200 mesh 29.3%; −200 to +325 mesh 11.6%; −325 mesh 5.3%. Hydrogen was not retained by the glass when the pressure was released.

EXAMPLE 3

Glassy metal alloy $Fe_{40}Ni_{40}P_{14}B_6$ (atom percent) was ground for 4 hrs. in the Magna Dash Unit under approximately 155 kg/cm$^2$ hydrogen pressure at room temperature. Particle size distribution analysis gave: −100 to +200 mesh 81.5%; −200 to +325 mesh 14.1%; −325 mesh 4.4%. Again, no retention of hydrogen was observed when the pressure was released.

EXAMPLES 4–8

Metallic glass in ribbon form of composition indicated in the Table, below, was ground in a hydrogen atmosphere at temperatures and for times given in the table. The resulting powder had a fine particle size between about 45 and 850 microns, as given in the table, and the powders were found to be amorphous by X-ray analysis and differential scanning calorimetry. The hydrogen which had been absorbed under high pressure was released when the hydrogen pressure was removed except in the case of TiCu which required prolonged evacuation and heating to remove absorbed hydrogen. The powder size is given in the Table in weight percentages for some ranges in size.

Nickel, cobalt and iron base metallic glass alloys containing chromium and molybdenum in powder form as obtained by the method of my invention are fabricated by powder metallurgical techniques into structural parts with excellent properties desirable for wear and corrosion resistant applications. Such materials will find uses in pumps, extruders, mixers, compressors, valves, bearings and seals especially in the chemical industry.

EXAMPLE 9

A metallic glass ribbon of composition TiCu was electrolyzed in an aqueous solution containing 0.1 moles/liter of $H_2SO_4$. The anode was platinum, the potential 10 volts and the current 0.567 amps; the time of electrolysis 1 hour. Upon completion of electrolysis a portion of the ribbon, which had become quite embrittled, was easily ground to <200 mesh powder and an X-ray pattern taken. The pattern showed that the amorphous structure was retained. Another portion of the ribbon was analyzed for hydrogen and a composition $TiCuH_{0.98}$ was indicated. The removal of hydrogen was difficult and required prolonged evacuation and gentle heating.

The results of Examples 1 through 8 are summarized in the Table, below.

TABLE

| Example | Composition (atom percent) | Charging Pressure kg/cm$^2$ | Charging Time [h] | Powder Size [microns] |
|---|---|---|---|---|
| 1 | $Fe_{84}B_{16}$ | 135 | 1.75 | Less than<br>45: 16.1%<br>45–75: 39.2%<br>75–150: 44.7% |
| 2 | $Ni_{45}Co_{20}Cr_{10}Fe_5Mo_4B_{16}$ | 125 | 1 | 45–75: 11.6%<br>75–150: 29.3%<br>150–1850: 53.8% |
| 3 | $Fe_{40}Ni_{40}P_{14}B_{16}$ | 155 | 4 | Less than<br>45: 4.4%<br>45–75: 14.1%<br>75–150: 81.5% |
| 4 | $Fe_{83}P_{16.5}Si_{0.5}$ | 130 | 4 | Less than<br>75: 100% |
| 5 | $Fe_{40}Ni_{38}Mo_4B_{18}$ | 146 | 3 | Less than<br>75: 6%<br>75–150: 22.1%<br>150–850: 71.9% |
| 6 | $Co_{60}Fe_{7.5}Ni_{7.5}Mo_2Si_8B_{15}$ | 145 | 5 | Less than<br>75: 11.6%<br>150–850: 44.9% |
| 7 | $Fe_{80}Si_{10}B_{10}$ | 143 | 5 | Less than<br>75: 3.9%<br>75–150: 23.8%<br>150–850: 72.4% |
| 8 | CuTi* | 1 | 6 | Less than<br>200: 100% |

*Hydrogen highly bound in this sample. Prolonged evacuation necessary for the removal of hydrogen.

I claim:

1. A ductile glassy metal powder produced by charging a solid metallic glass body with hydrogen at a temperature below its glass transition temperature for time sufficient to effect embrittlement; and comminuting the embrittled metallic glass body.

2. A ductile glassy metal powder as recited in claim 1, wherein said powder has a composition consisting essentially of that defined by the formula $M_aY_bZ_c$ where M is at least one of the metals iron, nickel, cobalt, chromium and vanadium; Y is at least one of the metalloids phosphorous, boron and carbon, Z is at least one of aluminum, silicon, tin, germanium, indium, antimony and beryllium, "a" equals 60–90 atom percent, "b" equals 10–30 atom percent and "c" equals 0.1–15 atom percent, with the proviso that the sum of a, b and c equals 100 atom percent.

3. A ductile glassy metal powder as recited in claim 2, wherein "a" ranges from about 75–80 atom percent, "b" ranges from about 9–22 atom percent and "c" ranges from about 1–3 atom percent.

4. A ductile glassy metal powder as recited in claim 1, wherein said powder has a composition consisting essentially of that defined by the formula $T_iX_j$ where T is at least one transition metal, X is at least one element of the group consisting of phosphorous, boron, carbon, aluminum, silicon, tin, germanium, indium, beryllium and antimony, "i" ranges from about 70–87 atom percent and "j" ranges from about 13–30 atom percent, with the proviso that $i+j=100$.

5. A ductile glassy metal powder as recited in claim 1, wherein said powder has a composition selected from the group consisting of $Be_{40}Ti_{50}Zr_{10}$, $Be_{35}Zr_{65}$, $Ni_{40}Fe_{40}P_{14}B_6$, $Fe_{84}B_{16}$, $Fe_5Ni_{45}B_{16}Mo_4Cr_{10}Co_{20}$, $Fe_{40}Ni_{40}P_{14}B_6$, subscripts in atom percent.

6. A ductile glassy metal powder as recited in claim 1, wherein the particle size is less than 4 mesh.

7. A ductile glassy metal powder as recited in claim 1, wherein the particle size ranges from about 325 mesh to 20 mesh.

* * * * *